United States Patent [19]

Kanamori

[11] Patent Number: 4,889,222

[45] Date of Patent: Dec. 26, 1989

[54] BALUSTRADE STRUCTURE FOR CURVED ESCALATOR

[75] Inventor: Osamu Kanamori, Inazawa, Japan

[73] Assignee: Mitsubishi Denki Kabushiki Kaisha, Japan

[21] Appl. No.: 36,206

[22] Filed: Apr. 8, 1987

Related U.S. Application Data

[63] Continuation of Ser. No. 768,879, Aug. 23, 1985, abandoned.

[30] Foreign Application Priority Data

| | | | |
|---|---|---|---|
| Aug. 27, 1984 | [JP] | Japan | 59-177654 |
| Dec. 13, 1984 | [JP] | Japan | 59-263175 |
| Dec. 13, 1984 | [JP] | Japan | 59-263176 |
| Jan. 28, 1985 | [JP] | Japan | 60-13818 |
| Jan. 28, 1985 | [JP] | Japan | 60-13819 |

[51] Int. Cl.[4] ..... B66B 21/06; B66B 23/22

[52] U.S. Cl. ..... 198/328; 198/335; 198/778; 52/187; 29/155 R; 29/446

[58] Field of Search ..... 198/328, 335, 337, 778; 52/182, 764, 766, 187; 29/155 R, 446; 72/136, 167

[56] References Cited

U.S. PATENT DOCUMENTS

| | | | |
|---|---|---|---|
| 3,190,408 | 6/1965 | Petterson | 52/766 X |
| 3,989,133 | 11/1976 | Courson et al. | 198/335 |
| 3,991,877 | 11/1976 | Kraft et al. | 198/335 |
| 4,722,164 | 2/1988 | Scholler | 52/187 X |

FOREIGN PATENT DOCUMENTS

| | | | |
|---|---|---|---|
| 0103489 | 3/1984 | European Pat. Off. | 198/328 |
| 686282 | 1/1940 | Fed. Rep. of Germany | 52/766 |
| 52-39273 | 3/1977 | Japan | 198/335 |
| 52-61087 | 5/1977 | Japan | 198/335 |
| 53-40988 | 4/1978 | Japan | 198/335 |
| 54-140387 | 10/1979 | Japan | 198/335 |
| 261299 | 5/1949 | Switzerland | 52/766 |
| 1071561 | 2/1984 | U.S.S.R. | 198/335 |
| 552040 | 3/1943 | United Kingdom | 52/766 |

OTHER PUBLICATIONS

*Time* Magazine,. Nov. 12, 1984, p. 87, "Up, Up and Around ".

*Research Disclosure,* No. 197, Sep. 1980, pp. 394–395, "Escalator skirt guard" (19754).

*Primary Examiner*—Robert J. Spar

*Assistant Examiner*—Lyle Kimms

*Attorney, Agent, or Firm*—Leydig, Voit & Mayer

[57] ABSTRACT

A balustrade structure for a curved escalator wherein at least one of an inner deck board and an outer deck board constituting a balustrade base portion of the escalator is constructed with a plurality of curved strips of a thin sheet which is straight in the transverse direction. A longitudinally-extending side edge of the curved sheet strips may be covered by a joint. The deck may comprise a main deck extending along the balustrade panel and an end deck disposed at the lengthwise ends of the main deck for covering the ends. The end deck has formed in its edge portion a slot into which the longitudinally-extending side edge of the main deck is inserted, and each of the deck boards comprises a main deck and an end deck. The end deck has formed in its edge portion a slot into which the longitudinally-extending side edge of the main deck is inserted, the slot has a width greater than the thickness of the main deck, and a space between the slot and the main deck is filled with a shim which is secured to the end deck.

10 Claims, 18 Drawing Sheets

BALUSTRADE STRUCTURE FOR CURVED ESCALATOR

This application is a continuation of application Ser. No. 768,879 filed Aug. 23, 1985, now abandoned.

FIELD OF THE INVENTION

This invention relates to a balustrade structure for a curved escalator, and particularly to a structure of a deck and a deck board disposed on the outer and the inner sides of the balustrade.

Prior Art

FIGS. 1 to 8 illustrate a conventional balustrade structure for a curved escalator of the type disclosed in Japanese Utility Model Application Laid-Open No. 59-83860. In the figures, reference numeral 1 designates a main frame having a circular shape in plan, 2 designates balustrades extending upwards along the longitudinally-extending side edges of the main frame 1. 2*a* is a balustrade panel and 2*b* is a moving handrail movably mounted around the outer circumference of the balustrade panel 2*a*, 3*a*–3*g* are inner deck boards constituting the base portion of the balustrade 2, and 4*a*–4*g* are outer deck boards corresponding to the inner deck boards 3*a*–3*g*. Reference numeral 5 designates a plurality of serially-connected segment steps.

Since the steps 5 of the curved escalator move along the spiral main frame 1, the major surfaces of the inner deck boards 3*a*–3*g* are inclined spiral surfaces and the major surfaces of the outer deck boards 4*a*–4*g* are spiral surfaces. The inclined spiral surfaces and the spiral surfaces can be referred to as three-dimensional curved surfaces since they are twisted curved surfaces in three-dimensional space. The balustrade 2 comprises horizontal portions 6 and 7 at the upper and the lower end portions, a constant slope portion 8 at the intermediate portion, an upper transition portion 9 between the upper horizontal portion 6 and the intermediate constant slope portion 8, and a lower transition portion 10 between the lower horizontal portion 7 and the intermediate constant slope portion 8.

A description will now be made of a conventional balustrade using the inner deck board 3*a* and the outer deck board 4*a* of the intermediate constant slope portion 8 as examples.

As shown in FIG. 5, the deck boards 3*a* and 4*a* of the curved escalator are disposed at different angles with respect to the horizontal, and as shown in FIGS. 6 and 7, the deck boards 3*a* and 4*a* are curved such that their horizontal projections have radii of curvature R1 and R2, respectively. Therefore, the deck boards 3*a* and 4*a* each have a three-dimensional surface, and they must be manufactured by pressing with a pressing machine. However, press work poses drawbacks which will be discussed below.

Since the inner deck boards 3*a*–3*g* and the outer deck boards 4*a*–4*g* usually have a length of about 2 to 3 meters, the press dies for pressing the deck boards are very large and expensive. Furthermore, in a curved escalator, since many kinds of deck boards having differing configurations and dimension are needed not only for the deck boards 3*a* and 4*a* for the intermediate constant slope portion of the stairway, but also for the upper transition portion 9, the lower transition portion 10 as well as the inner and the outer side of the balustrade 2, the number of kinds of press dies for manufacturing the deck boards 3*a*–3*g* and 4*a*–4*g* shown in FIGS. 3 and 4 is fourteen, and the total number including the press dies for a curved escalator which curves in the opposite direction from that shown in the figures amounts to twenty-eight press dies, and thus the total cost for the dies is externally high.

Also, since after the press work has been finished, redundant material provided around the design configuration, i.e., a flange for removing wrinkles from the product must be cutoff to obtain a desired configuration, special tools or jigs are needed and much working time is required due to the three-dimensional curved configuration.

Also, since many large press dies are required and replacement of the press dies requires much time, resulting in an expensive curved escalator.

Furthermore, press forming generates scratches on the surfaces of the formed product, requiring further time for removing them.

In addition, since the formed products have three-dimensional curved surfaces, it is difficult to wrap them for shipping and the volume of wrapping is increased, increasing wrapping and shipping costs.

SUMMARY OF THE INVENTION

Accordingly, an object of the present invention is to provide a balustrade structure for a curved escalator in which the above-discussed drawbacks of conventional curved escalator are eliminated.

Another object of the present invention is to provide a balustrade structure for a curved escalator in which the manufacture of the escalator is easy and the manufacturing cost can be decreased.

Still another object of the present invention is to provide a balustrade structure for a curved escalator in which various kinds of material can be used.

Still another object of the present invention is to provide a balustrade structure for a curved escalator in which the forming of parts of complex shape, cutting, and correction of deformation are unnessesary.

A still further object of the present invention is to provide a balustrade structure for a curved escalator in which an error in the longitudinal length of the main deck can be easily corrected.

Another object of the present invention is to provide a balustrade structure for a curved escalator in which the end portions of the main deck are strong enough to endure an external downward force.

A further object of the present invention is to provide a balustrade structure for a curved escalator in which springback of the ends of the deck board in the vicinity of the support posts of the outer deck board can be prevented without degrading the external appearance of the escalator.

With the above objects in view, the present invention provides a balustrade structure for a curved escalator, wherein at least one of an inner deck board and an outer deck board constituting a balustrade base portion of the escalator is constructed with a plurality of curved strips of a thin sheet having a quadrilateral-shaped transverse cross section, i.e., the strips are straight in the transverse direction.

A longitudinally-extending side edge of the curved strips of sheet material may be covered by a joint or support member. A deck may comprise a main deck extending along the balustrade panel and end decks disposed at the lengthwise ends of the main deck for covering the ends. Each end deck has formed in its edge portion, a slot to receive a longitudinally-extending side edge of the main deck board. The slot has a width greater than the thickness of the main deck, and a space between the slot and the main deck is filled with a shim which is secured to the end deck.

BRIEF DESCRIPTION OF THE DRAWINGS

The present invention will now be described in terms of preferred embodiments of the invention together with the accompanying drawings, in which.

PREFERRED EMBODIMENTS OF THE INVENTION

Figure 1:
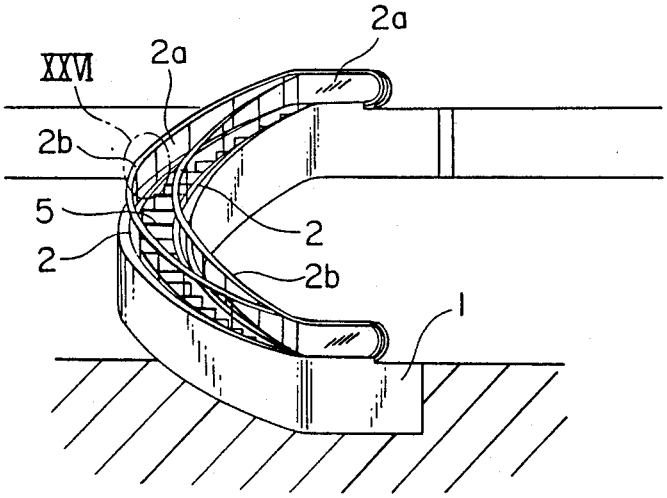
FIG. 1 PRIOR ART
FIG. 1 is a side view of a balustrade structure of a conventional curved escalator.
Figure 2:
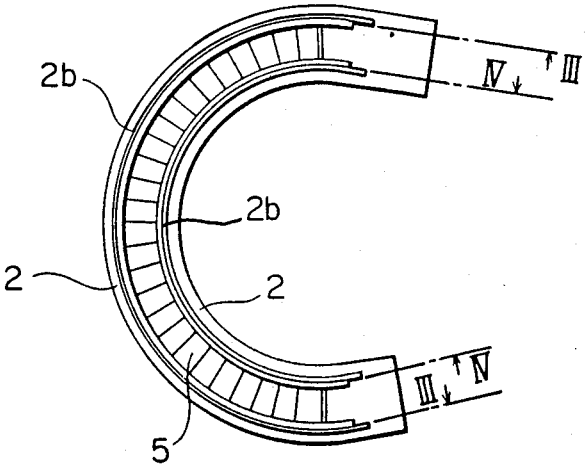
FIG. 2 PRIOR ART
FIG. 2 is a plan view of the escalator of FIG. 1.
Figure 3:
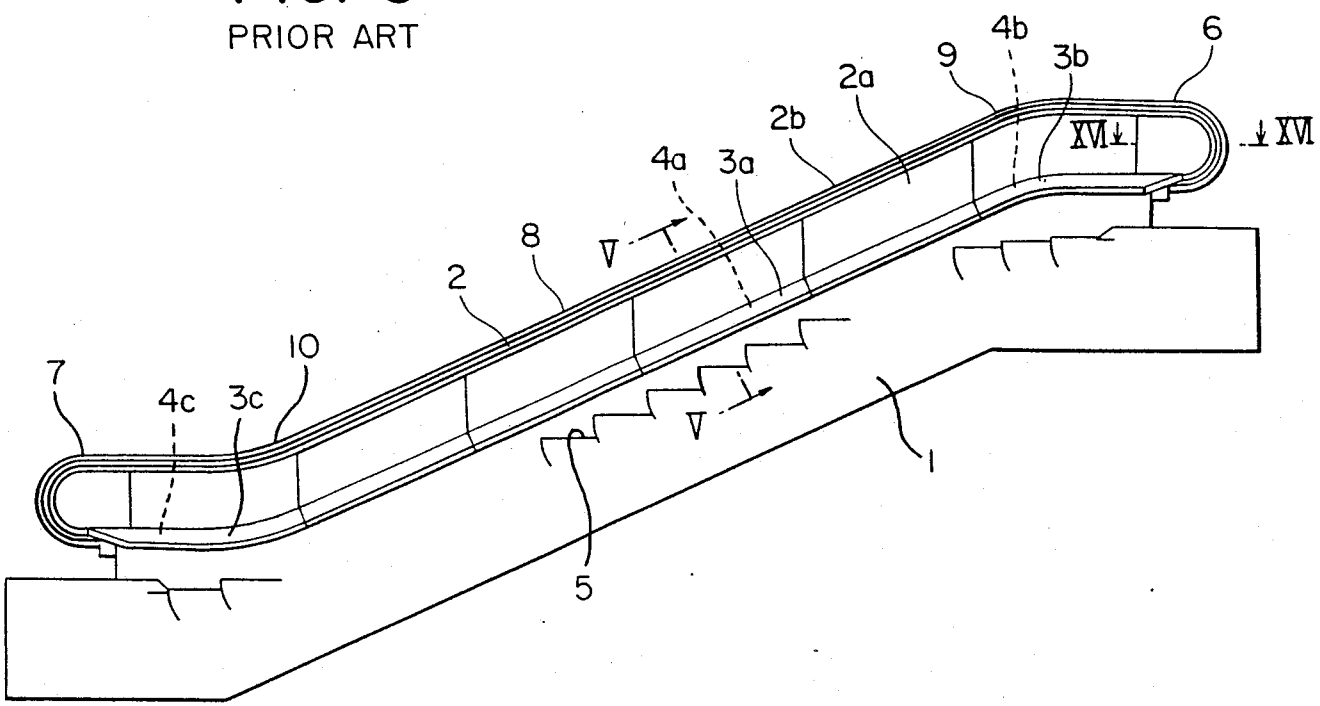
FIG. 3 PRIOR ART
FIG. 3 is an enlarged expanded view taken along Line III—III of FIG. 2.
Figure 4:
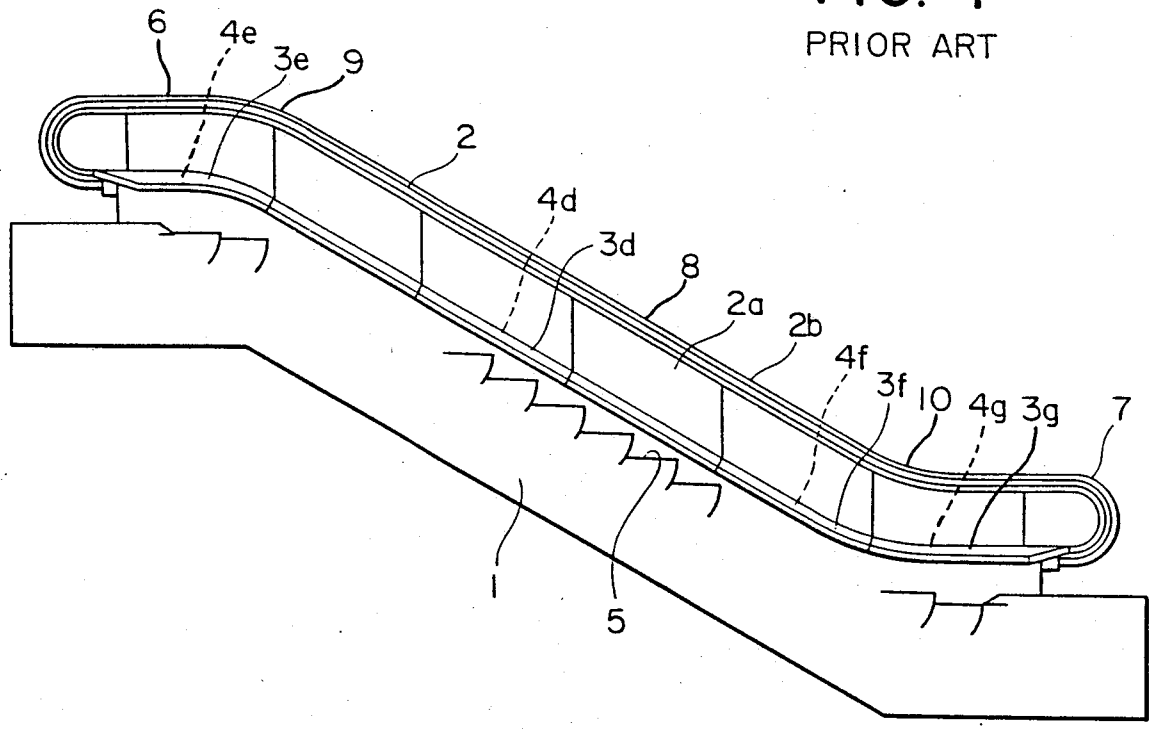
FIG. 4 PRIOR ART
FIG. 4 is an enlarged expanded view taken along Line IV—IV of FIG. 2.
Figure 5:
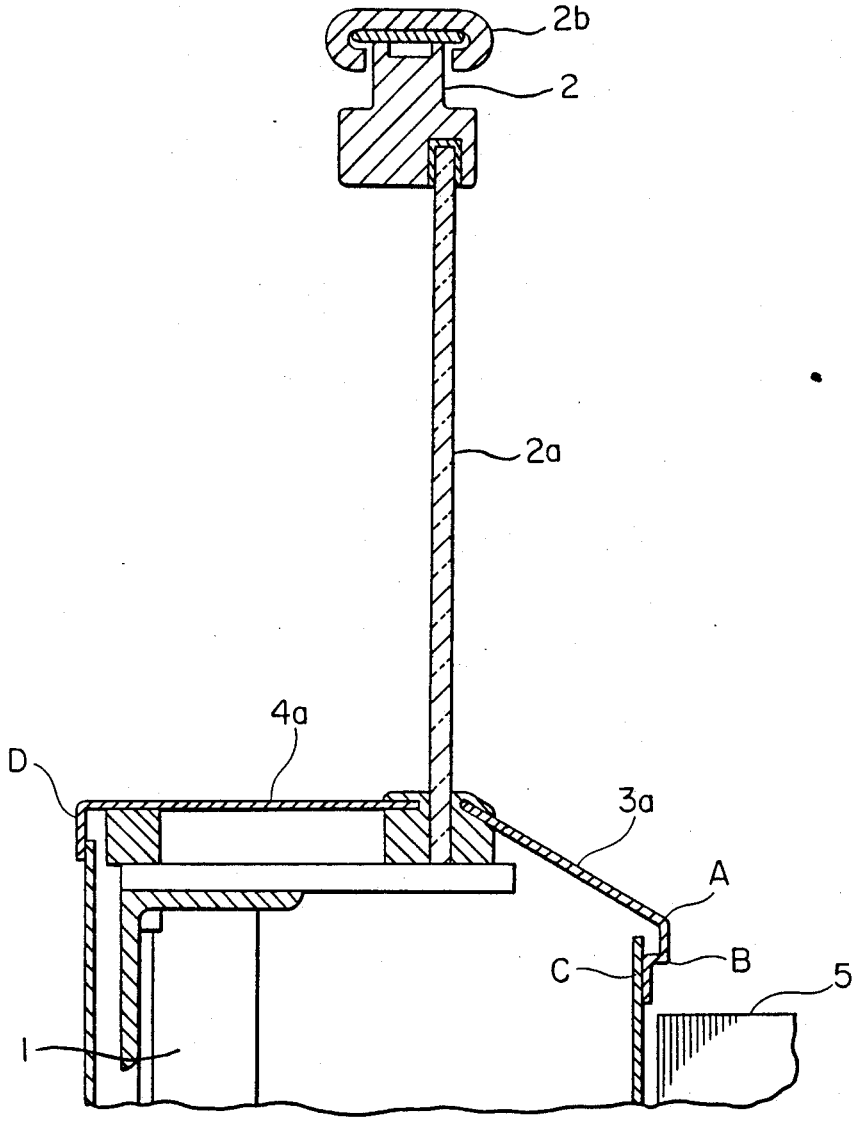
FIG. 5 PRIOR ART
FIG. 5 is an enlarged sectional taken along Line V—V of FIG. 3.
Figure 6:
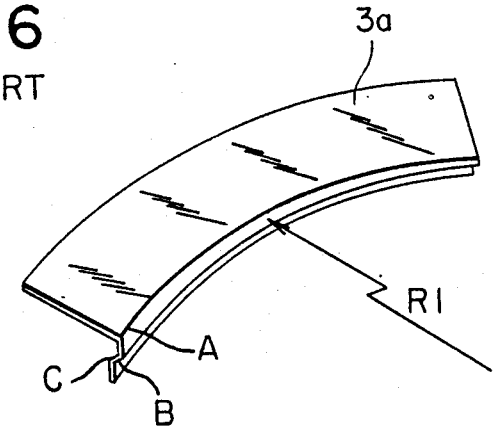
FIG. 6 PRIOR ART
FIG. 6 is a perspective view of the inner deck board shown in FIG. 5.
Figure 7:
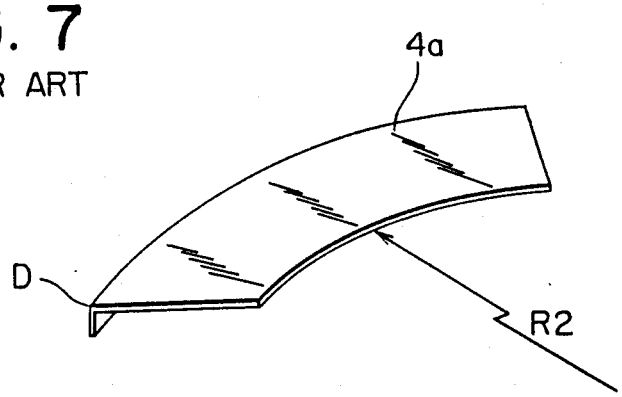
FIG. 7 PRIOR ART
FIG. 7 is a perspective view of the outer deck board shown in FIG. 5.
Figure 8:
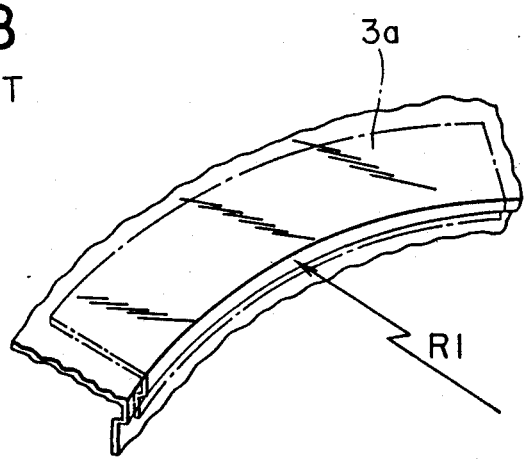
FIG. 8 PRIOR ART
FIG. 8 is an explanatory view illustrating the press-forming method of manufacturing the inner deck board shown in FIG. 6.
Figure 9:
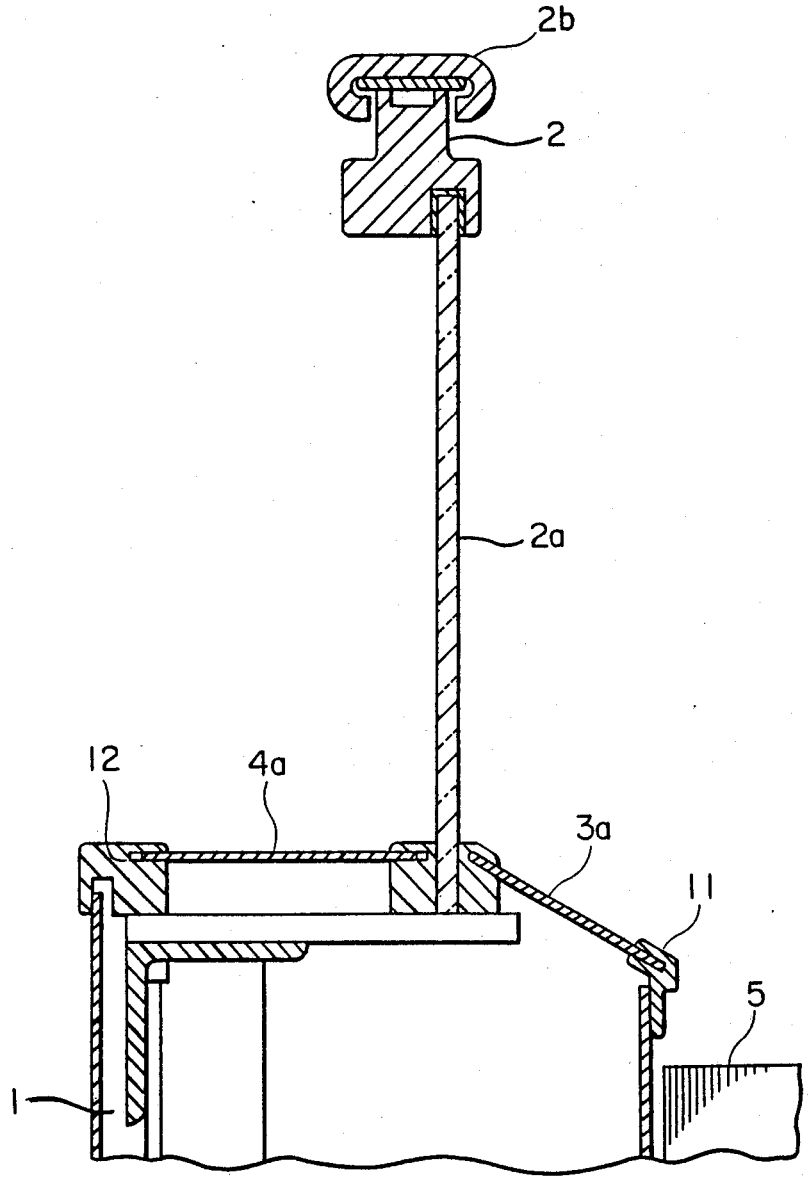
FIG. 9 is a sectional view of one embodiment of the balustrade structure for a curved escalator of the present invention.
Figure 10:
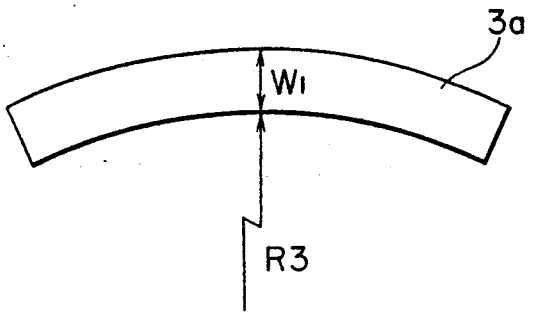
FIG. 10 is a plan view of the inner deck board shown in FIG. 9.
Figure 11:
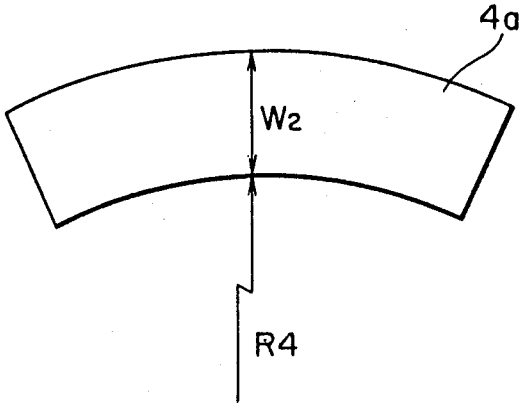
FIG. 11 is a plan view of the outer deck board shown in FIG. 9.

FIGS. 9 to 11 illustrate one embodiment of the present invention, and reference numerals identical to those used in FIGS. 1 to 8 designate the same or corresponding components. Reference numeral 3*a* indicates an inner deck board which is a sector of a ring cut from a relatively thin, flat, metallic sheet having a radius of curvature R3 at the inner periphery and a width of W1, the sheet being straight in the transverse direction as shown in FIGS. 9 and 10. Reference numeral 4*a* designates an outer deck board which is a sector of a ring cut from a thin, flat, metallic sheet having a radius of curvature R4 at the inner periphery and a width of W2 and being straight in the transverse direction as shown in FIGS. 9 and 11. The arcuated configurations of these deck boards 3*a* and 4*a* are those which can be obtained by expanding the deck boards 3*a* and 4*a* which are attached in accordance with a three-dimensional curve, so that their radii of curvature are R3 and R4 different from the radii of curvature R1 and R2 of the deck boards 3*a* and 4*a* shown in FIGS. 6 and 7. 11 and 12 designate support members arranged along the longitudinally-extending edges of the deck boards 3*a* and 4*a* to cover the cut ends of the deck boards 3*a* and 4*a* and to firmly hold the end portion of the deck boards 3*a* and 4*a*.

Although the deck boards 3*b*, 3*c*, 3*e*, 3*f*, 3*g*, 4*b*, 4*c*, 4*e*, 4*f*, and 4*g* of an upper curved portion 9 and a lower curved portion 10 are not single circular arcs, they are also cut from a thin flat sheet in accordance with the respective differing arcs in a manner similar to the deck boards 3*a* and 4*a* in the constant slope section 8.

A three-dimensional curved surface such as formed by the inner deck boards 3*a*–3*g* and the outer deck boards 4*a*–4*g* of the curved escalator cannot exactly replace a single flat surface. This can be easily understood considering the fact that a flat plate cannot fit onto a spherical surface. Therefore, while it is generally impossible to expand the respective deck boards 3*a*–3*g* and 4*a*–4*g* which theoretically are three-dimensional curved surfaces, the deck boards 3*a*–3*g* and 4*a*–4*g* can be closely expanded into a flat plane when the transverse cross-sectional shape of the board is a quadrilateral and when the widths W1 and W2 of the boards and the thicknesses are selected to be sufficiently small compared to the radii of curvature R1 and R2 of the deck boards 3*a*–3*g* and 4*a*–4*g*. The deviation from the true configuration can be accommodated by the support members 11 and 12 disposed along the longitudinally-extending edges of the deck boards 3*a*–3*g* and 4*a*–4*g*.

Thus, by forming the deck boards 3*a*–3*g* and 4*a*–4*g* from flat sheets, the deck boards can be easily cut from a thin sheet without requiring press work. Therefore, the manufacturing process is very easy and the costs can be significantly reduced because pressing dies are not necessary. Also, since no pressing dies are used and no scratches are formed, materials which must not be scratched can be employed. Materials which are not suitable for pressing can also be used. Therefore, a wide variety of materials can be employed for the deck boards, enabling a much wider variety of balustrade structures.

While in the above-described embodiment both the inner and the outer deck boards 3a–3g and 4a–4g are formed of thin flat sheets, similar effects can be obtained even if only one of them is so formed.

As has been described, according to the present invention, at least one of an inner deck board and an outer deck board constituting a balustrade base portion of a curved escalator is constructed with a plurality of curved strips of a thin sheet which is straight in the transverse direction. Therefore, the deck boards can be very easily manufactured without the need for press work, eliminating the need for press dies and significantly reducing the production costs. Also, since pressing scratches are not generated on the deck board surface and materials which are not suitable for pressing work can be employed, the range of materials from which the deck boards can be made is increased.

Figure 12:
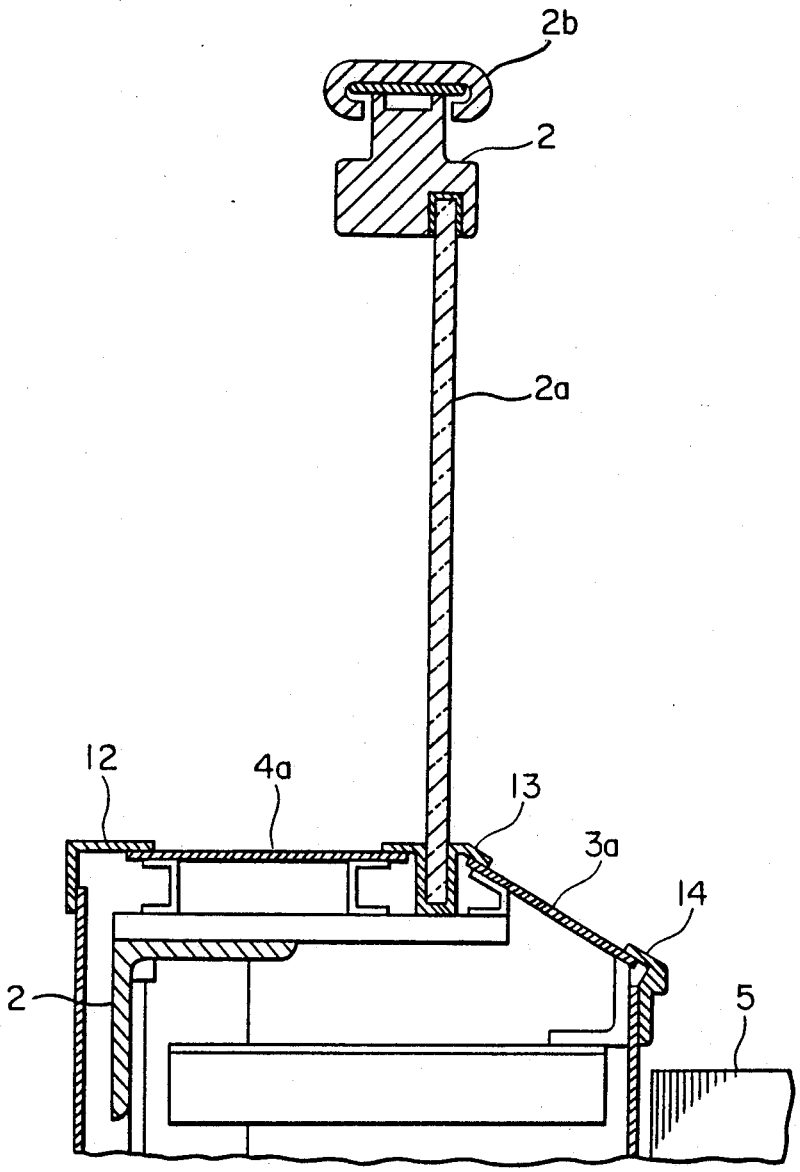
FIG. 12 is a sectional view showing another embodiment of the present invention.
Figure 13:
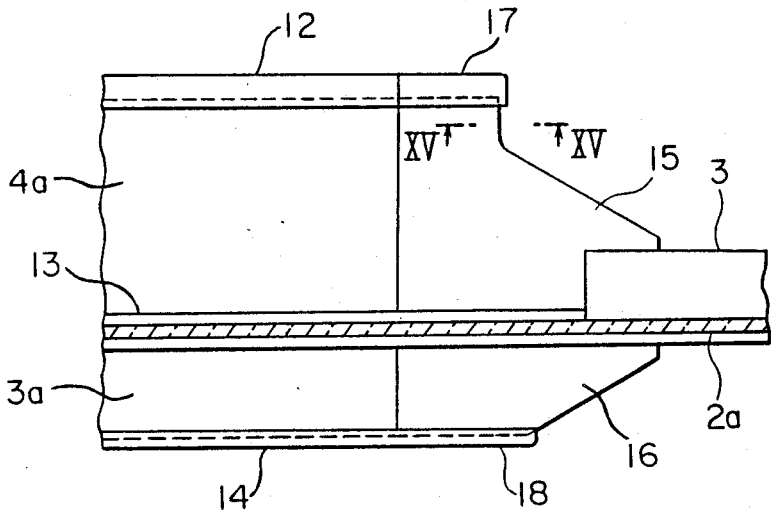
FIG. 13 is a sectional view taken along Line XVI—XVI of FIG. 3 but showing outer and inner main deck boards of the present invention and conventional end decks.
Figure 14:
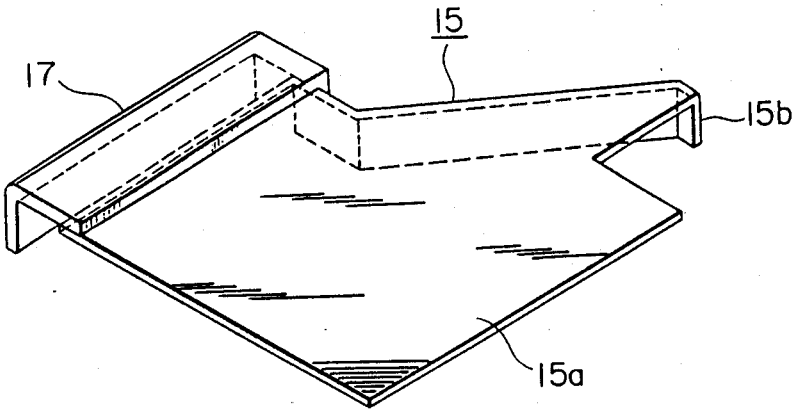
FIG. 14 is a perspective view of the outer main deck portion shown in FIG. 13.
Figure 15:
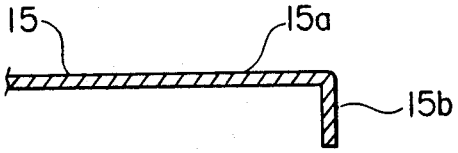
FIG. 15 is a sectional view taken along Line XV—XV of FIG. 13.

FIGS. 12 to 15 are explanatory views to illustrate another embodiment of the present invention. In FIG. 12, reference numeral 12 designates a joint for covering an outer edge of the outer main deck 4a, 13 a joint or support member for covering an outer edge of the inner main deck 3a and an inner edge of the outer main deck 4a of the present invention as well as receiving the bottom edge of the balustrade panel 2a, 14 a joint or support member for covering an inner edge of the inner main deck 3a. Now turning to FIGS. 13–15, these figures illustrate the main decks of the invention and auxiliary decks at the ends of the main deck having flanges like the prior art main decks of FIGS. 6–8, and thus illustrate prior art structures of auxiliary decks. Thus, 15 an outer auxiliary deck disposed at the end portions of a conventional escalator i.e., the turn-around portions of the moving handrail 6 of the outer main deck 4a. Auxiliary deck 15 comprises a flat portion 15a flushed with the outer main deck 4a and a folded portion 15b folded down at the end portion of the flat portion 15a, 16 an inner auxiliary deck disposed so as to be flushed with the inner main deck 3a, 17 a joint or support member which has the same cross section as the joint 12 and which covers the outer edge of the outer auxiliary deck 15, and 18 a joint or support member which has the same cross section as the joint 14 and which covers the inner edge of the inner auxiliary deck 16.

With the above arrangement, the main decks 4a and 3a, the auxiliary decks 15 and 16, and the joints 12, 14, 17, and 18 are separately constructed. This is because the balustrade of the curved escalator is of a spiral shape since the steps 5 travel along a spiral stairway. Therefore, it is difficult to integrally form the outer main deck 4a with the joint 12 and the inner main deck 3a with the joint 14. For this reason, the outer main deck 4a and the inner main deck 3a are made, for example, from a thin stainless steel sheet, and the joints 12 and 14 are made, for example, of extruded aluminum, and the outer auxiliary deck 15 and the joint 17, and the inner auxiliary deck 16 and the joint 18 are separately constructed.

With the balustrade of a curved escalator as described above, the shapes of the auxiliary decks 15 and 16 are complicated and it is very difficult and time-consuming to form the end portions into a desired configuration. If the end portion is welded after being folded, weld traces appear and local deformations develop, requiring significant time and work for correcting them. If a dimensional error appears in the longitudinal direction of the auxiliary decks 15 and 16 or in the stairway length when there is no means for adjusting the longitudinal length of the auxiliary decks 15 and 16, the mounting positions of the tips of the auxiliary decks 15 and 16 are displaced from the desired positions.

Figure 16:
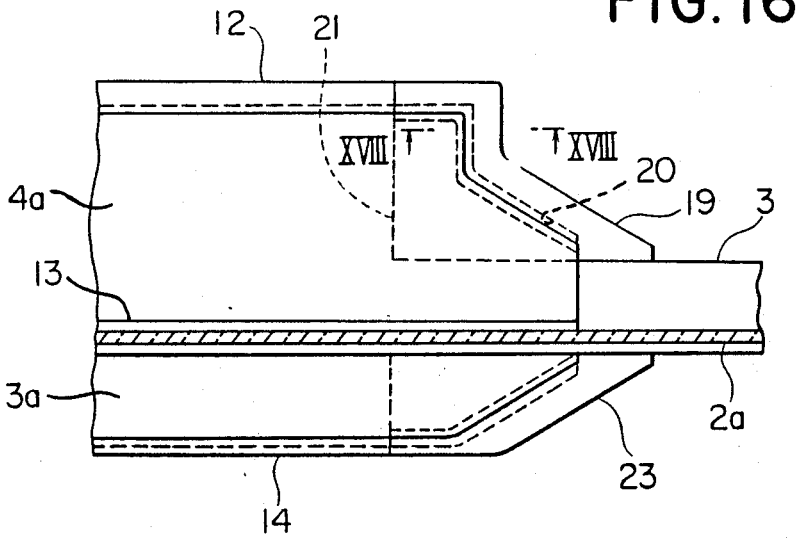
FIG. 16 is a sectional view taken along Line XVI—XVI of FIG. 3 but showing the ends of the main deck boards of the present invention.
Figure 17:
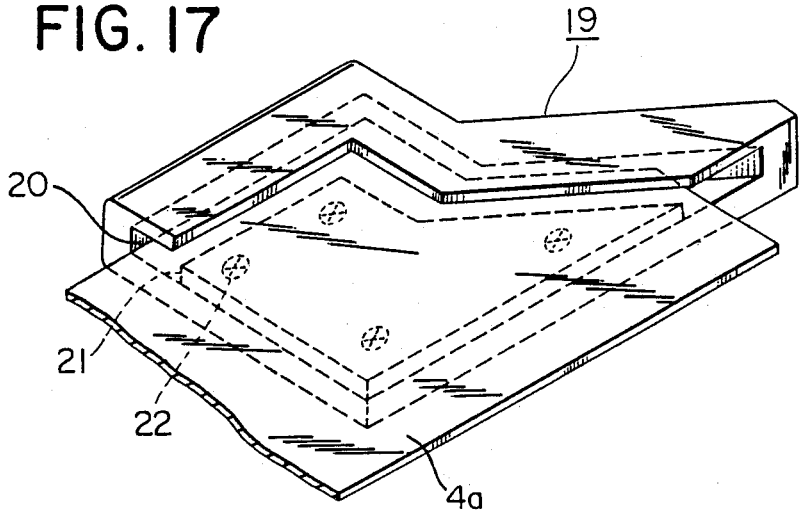
FIG. 17 is a perspective view of the end of the outer main deck board shown in FIG. 16.
Figure 18:
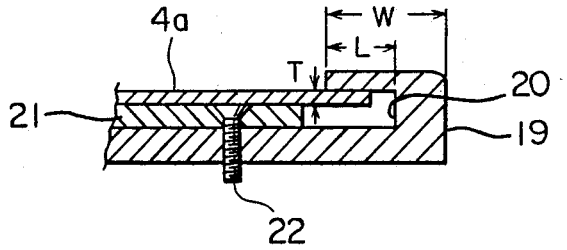
FIG. 18 is a sectional view taken along Line XVIII—XVIII of FIG. 16.

FIGS. 16 to 18 illustrate another embodiment of the invention in which the above-explained problems are solved. In the figures, reference numeral 19 designates an outer end deck attached to the end portion of the outer main deck 4a, the outer end deck 19 having formed at its edge portion a groove 20 wider than the thickness of the outer main deck 4a in which the end portion of the outer main deck 4a is received. Reference numeral 21 indicates a shim which is secured to the outer end deck 19 by means of screws 22 and which has a thickness equal to the width of the groove 20 minus the thickness T of the outer main deck 4a for filling the space between the groove 20 and the outer main deck 4a, and 23 is an inner end deck secured to the end portion of the inner main deck 3a.

It is seen that the end portions of the outer main deck 4a and the inner main deck 3a remain flat as cut and are not folded or bent. The outer end deck 19 and the inner end deck 23 are formed by machining the same material used for the joints 12 and 14.

The flat outer main deck 4a is inserted into the groove 20 of the outer end deck 19 or the inner end deck 23 in such a manner that the amount of insertion can be adjusted. The depth L of the groove 20 is determined so as to allow the absorbing of accumulated errors of the plurality of outer main decks 4a mounted along the entire length of the curved escalator. The depth is usually from 15 mm to 20 mm. Thus, the external width should preferably be greater than 20 mm. The groove 20 may easily be formed by a usual machine since it is wide.

Thus, according to the invention, the outer end deck 19 can be attached to restore end portion of the outer main deck 4a, without need for complicated folding or bending and the correction of deformations. Also, manufacturing errors in the longitudinal length of the outer main deck 4a can easily be adjusted.

Furthermore, since the end portion of the outer main deck 4a is inserted within the groove 20 of the outer end deck 19 and sufficiently reinforced, any external force such as one exerted when a passenger steps on the end portion of the main deck can be sufficiently resisted.

As has been described, this embodiment is advantageous in that the groove of the end deck can be machined with a usual machine and errors in the longitudinal dimension of the main deck can easily be adjusted.

Figure 19:
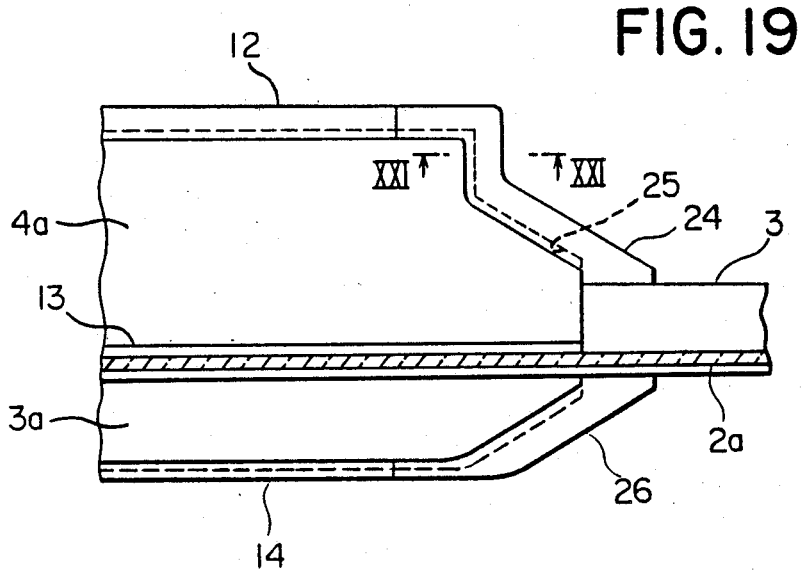
FIG. 19 is a sectional view of a balustrade of another embodiment of the present invention.
Figure 20:
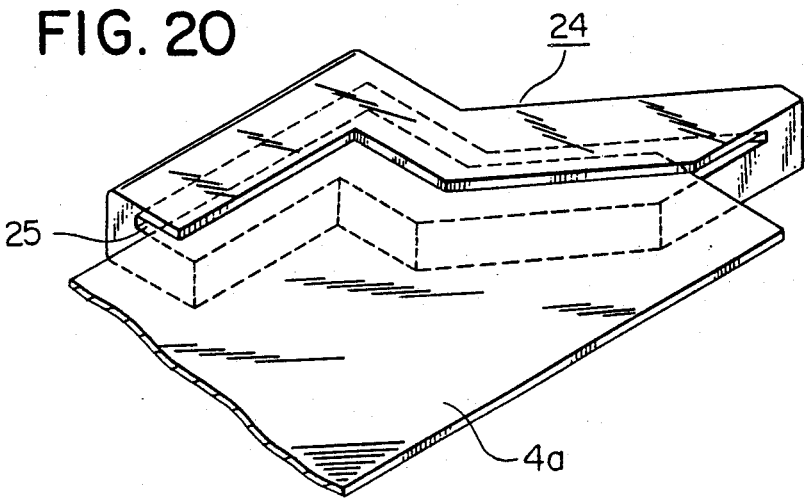
FIG. 20 is a perspective view of the outer main deck portion shown in FIG. 19.
Figure 21:
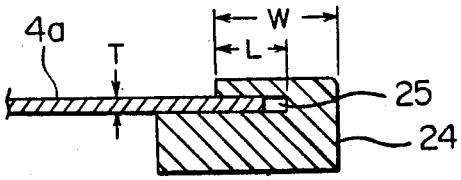
FIG. 21 is a sectional view taken along Line XXI—XXI of FIG. 19.

FIGS. 19 to 21 illustrate another embodiment of the present invention. In the figures, reference numeral 24 designates an outer end deck attached to the end portion of the outer main deck 4a, the outer end deck 24 having formed at its edge portion a groove 25 wider than the thickness of the outer main deck 4a in which the end portion of the outer main deck 4a is received, and 26 is an inner end deck secured to the end portion of the inner main deck 3a. This embodiment also provides advantages similar to those of the previous embodiment.

Figure 22:
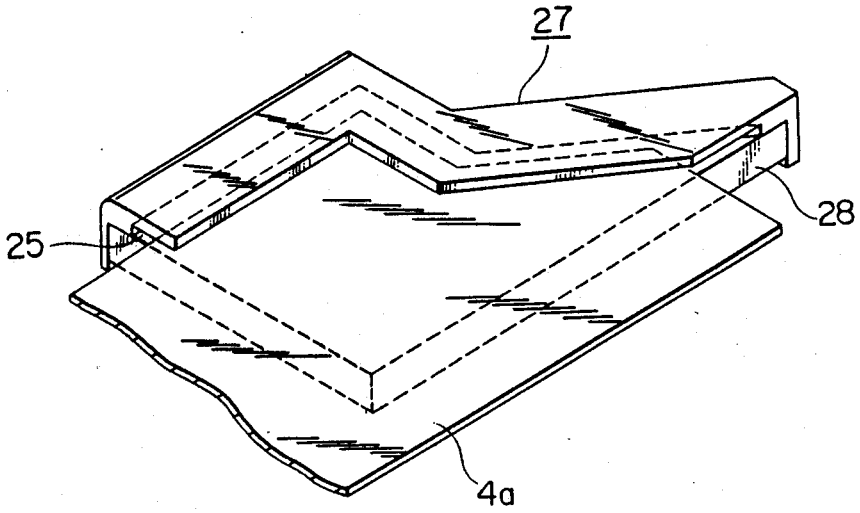
FIG. 22 is a perspective view of the outer main deck portion shown in FIG. 19.
Figure 23:
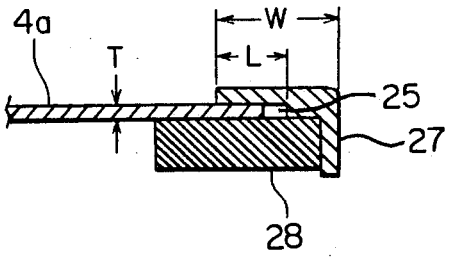
FIG. 23 is a sectional view of FIG. 22 but corresponding to the section taken along Line XXI—XXI of FIG. 19.

FIGS. 22 and 23 illustrate another embodiment of the end deck of the present invention. In the embodiment shown in FIGS. 19 and 20, the groove 25 formed in the outer end deck 24 must have a width substantially equal to the thickness T of the outer main deck 4*a*. However, since the thickness T of the outer main deck 4*a* is usually only 1.5 mm to 2 mm, a special machine or tool is necessary for machining the desired narrow groove. The embodiment shown in FIGS. 22 and 23 is improved in this respect, and an outer end deck 27 is formed to have an L-shaped cross section and a support member 28 is secured on the back surface of the deck to define a groove 25 therebetween.

With this arrangement, the outer end deck 27 can easily be manufactured without the need for complicated folding or bending work and the correction of deformation. Also, manufacturing errors in the length of the outer main deck can easily be adjusted. Furthermore, since the end portion of the outer main deck is inserted within the groove of the outer end deck and sufficiently reinforced, any external force such as one exerted when a passenger steps on the end portion of the main deck can be sufficiently resisted.

Figure 24:
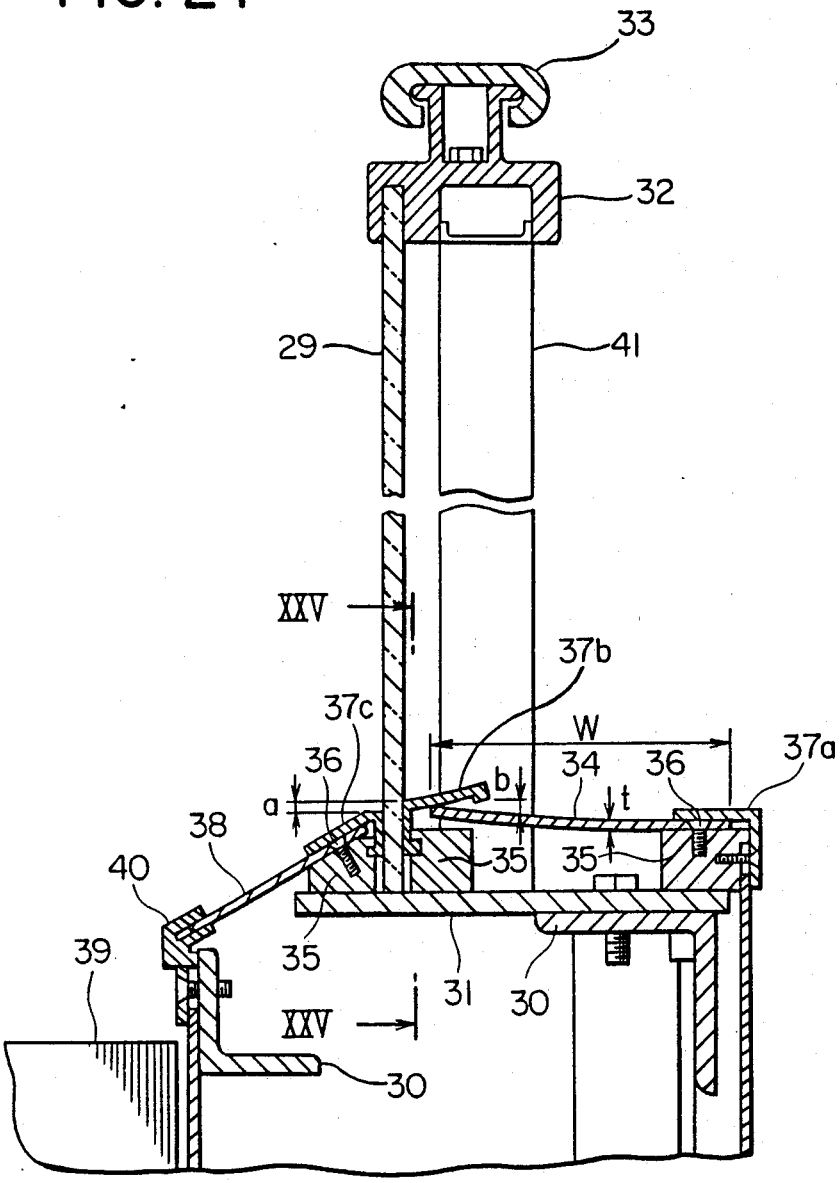
FIG. 24 is a sectional view of the main portion of the balustrade in accordance with an embodiment of the present invention.
Figure 25:
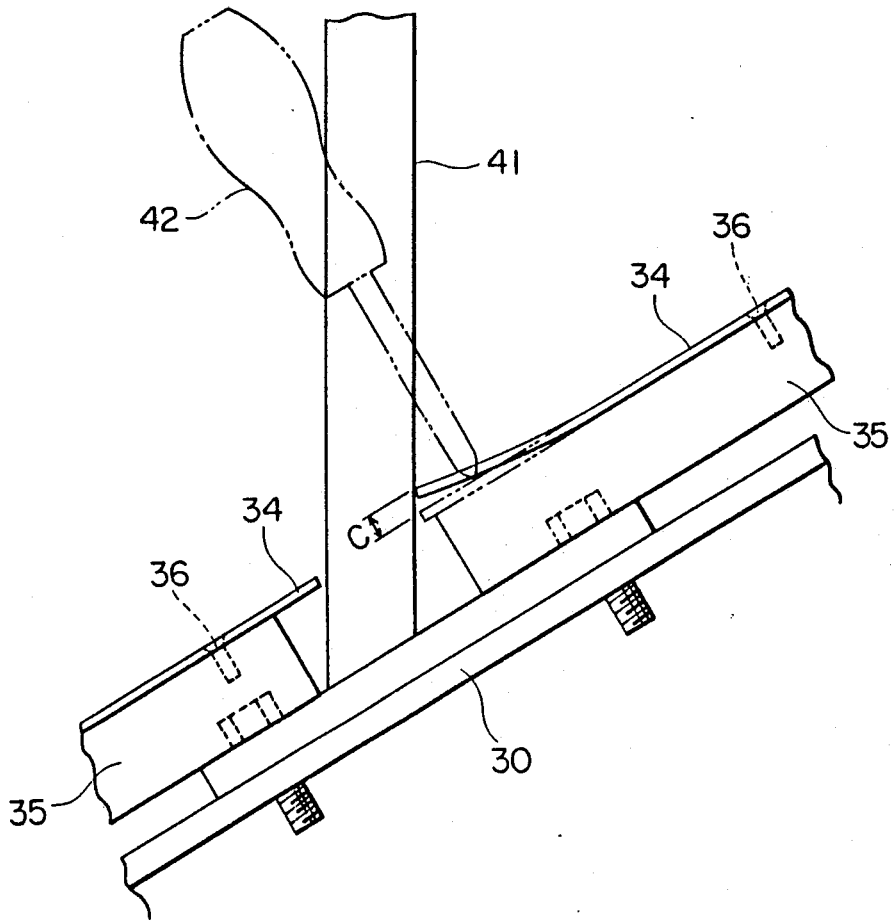
FIG. 25 is a view taken along Line XXV—XXV of FIG. 24, schematically illustrating the assembling operation.
Figure 26:
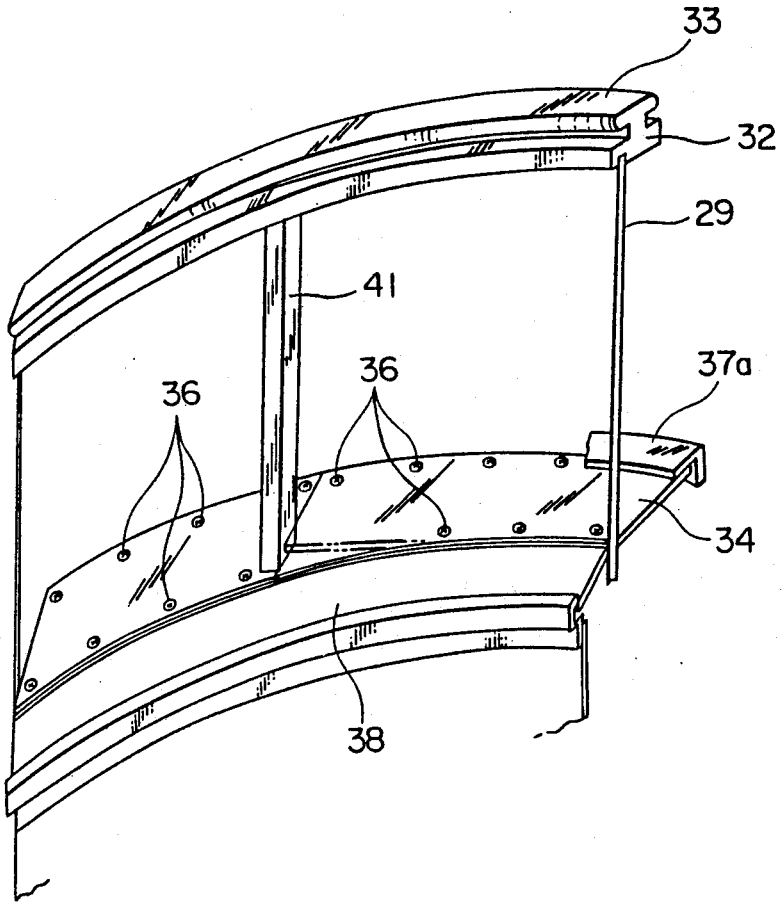
FIG. 26 is an enlarged perspective view illustrating a portion of a balustrade embodying an improvement over the embodiments of FIGS. 24–25 but showing the main decks of the present invention.

FIGS. 24 to 26 are explanatory views illustrating the main deck boards of the present invention and the problem of retaining the deck boards in position in the vicinity of the support posts. In these figures, in which a structure for mounting the balustrade on the curved escalator is illustrated, reference numeral 29 designates a balustrade panel mounted vertically on the inside of the support plate 31 which is horizontally mounted along the circular arc of a main frame 30 and is provided at its top edge with a moving handrail 33 by means of a handrail guide 32. Reference numeral 34 designates an outer deck board having a width W for covering the internal structure of the main frame 30 at the outer side of the balustrade panel 29. The deck board 34 is secured to the mount rail 35 and support rail 35' disposed along the inner and outer edges of the support plate 31 by screws 36, and the screwed inner edge of the outer deck board 34 is covered by a packing 37*b* made of soft rubber. Reference numeral 38 is an inner deck board which is positioned so that its outer edge is at substantially the same level as the upper surface of the outer deck board 34 and its inner edge is lowered toward the steps 39. The side edge of the inner deck board 38 which is close to the balustrade panel 29 is fastened to the mount rail 35 by screws and covered by a packing 37*c* made of a material similar to that of the packing 37*b*, and the other side edge close to the steps 39 is inserted into and held by the groove formed in the support member 40 secured on the upper edge of the main frame 30. Reference numeral 41 designates support posts positioned at predetermined intervals for reinforcing the balustrade panel 29. 37*a* is a member for covering the outer edge of the outer deck board.

With the above construction, each of the deck boards 34 and 38 has a three-dimensional structure and must be twisted in accordance with the curve of the escalator. However, such three-dimensional forming cannot be obtained by a simple forming of a flat sheet and a distortion remains in a flat sheet. As a counter-measure for this distortion, the width W and the thickness t of the outer deck board 8 are selected to be sufficiently small compared to the radius of curvature R of the curved escalator to utilize the elastic deformation of the flat sheet thereby obtaining a three-dimensional curved structure under forced conditions. However, with this measure, the pitch of the screws for securing the outer deck board 34 to the mount rail 35 and support rail 35' must be as small as possible. When a screw is located in the vicinity of the support post 41 as shown in FIG. 25, the assembly cannot be completed due to the interference of a screw driver 42 with the support post 41. Therefore, the end portion of the outer deck board 34 may overcome the elasticity of the packing 37*b* of the base portion of the balustrade panel 29 to push up the packing 37*b* as shown in FIG. 24, resulting in a level difference a between the packings 37*c* and 37*b* as well as a gap b between the packing 37*b* and the outer deck board 34. Furthermore, a level difference c appears between the lifted portion and the adjacent, completely secured portion of the deck board as shown in FIGS. 25 and 26 to produce a wavy appearance of the deck board, degrading its external appearance.

Furthermore, in order to firmly secure the deck boards 34 and 38 to the mount rail 35, a large number of screws 36 are necessary, and in order to use screws the deck boards 34 and 38 must be positioned sufficiently accurately with respect to the mount rail 35 during field installation, significantly decreasing the assembling efficiency. This becomes worse when the deck board 34 is in a wavy shape as shown in FIG. 25.

Figure 27:
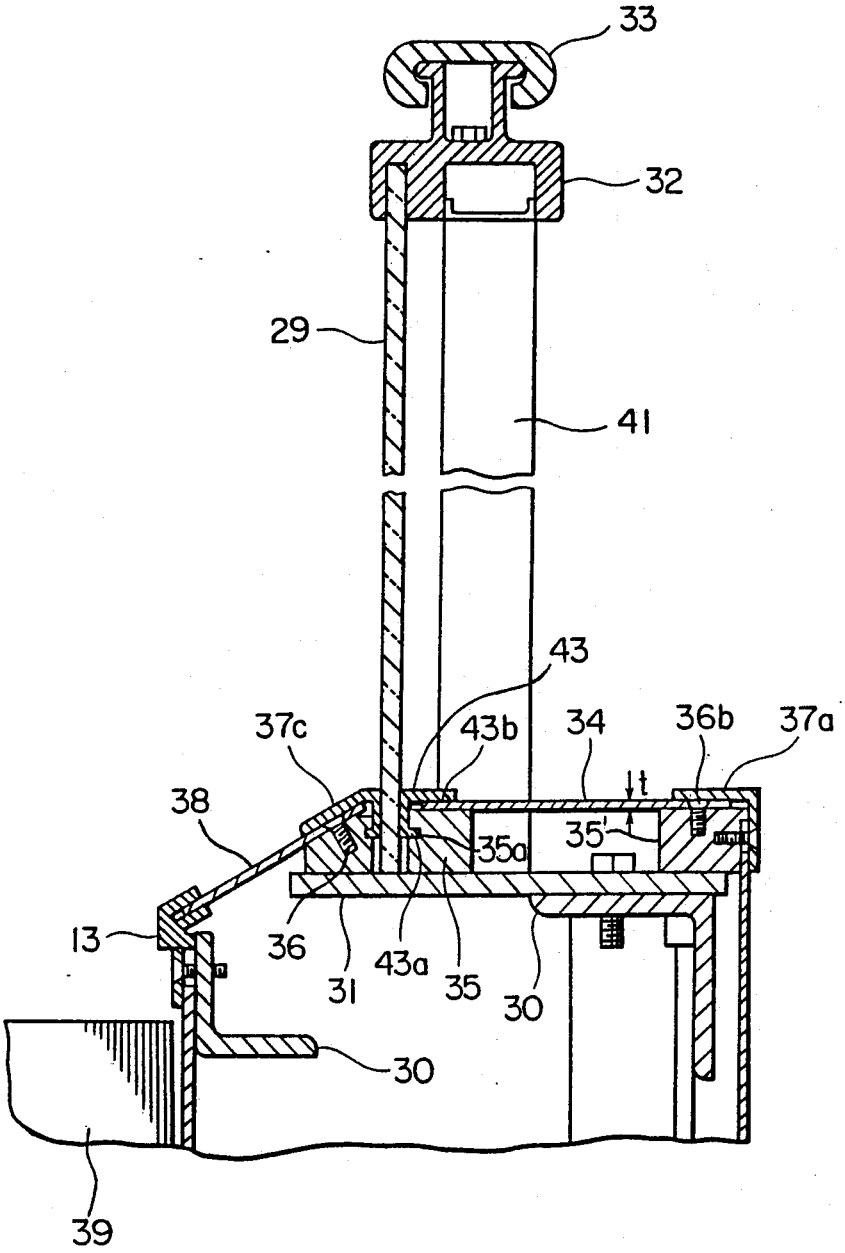
FIG. 27 is a sectional view of the main portion of the balustrade structure of a curved escalator of another embodiment of the present invention.

FIG. 27 illustrates another embodiment of the present invention which is improved with respect to the problems described above. In the figure, reference numeral 43 designates a hard packing which is an elongated member of a hard synthetic resin having a substantially U-shaped cross section. The packing has a strength sufficient to prevent the deformation of the deck board due to springback. One of the leg portions of the U is shorter than the other and this shorter leg 43*a* engages the groove 35*a* formed in the side face of the mount rail 35. The other leg portion 43*b* extends parallel to the shorter leg 43*a* and is separated from the mount rail 35 a distance corresponding to the thickness t of the outer deck board 34 therebetween. Therefore, when the hard packing 43 is attached after the outer deck board 34 is secured to the mount rail 35 and support rail 35' by screws 36, the deformation of the outer deck board 34 can be prevented due to the clamping force of the hard packing 43 even when the support posts 41 on the base portion of the balustrade panel 29 impede the complete securing of the deck board or when the pitch of the screws 36 is large. As a result, the generation of the wavy shape of the inner edge portion of the outer deck board can be significantly reduced and the lifting of the hard packing 43 is prevented so that no level difference a or gaps b and c are formed.

The material used for the hard packing 43 which prevents the deformation of the outer deck board 34 may be one having a modulus of elasticity of from 200 $kg/mm^2$ to 300 $kg/mm^2$, suitable resins being hard vinyl chloride resin and ABS resin.

According to the above embodiment, not only can springback of the deck board be prevented but also the pitch of the screws for securing the deck board can be increased, whereby the assembly efficiency can be significantly increased.

Figure 28:
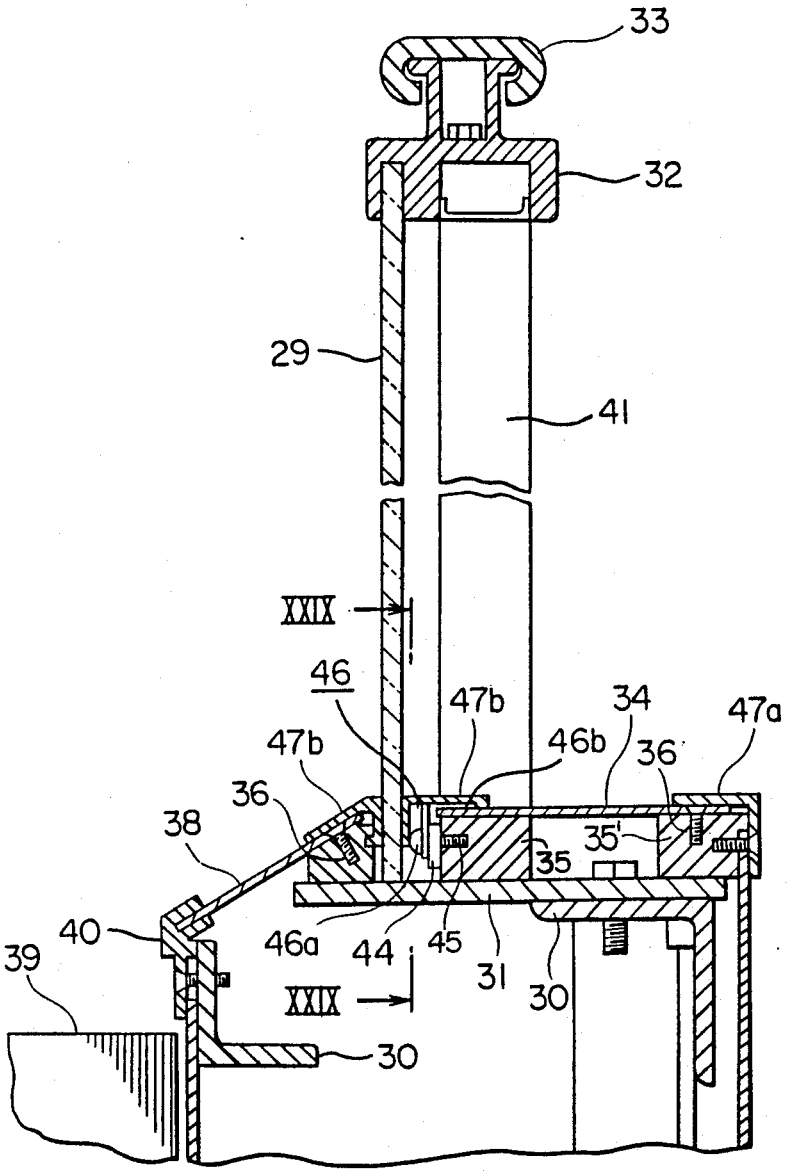
FIG. 28 is a sectional view of the main portion of the balustrade structure of still another embodiment of the present invention.
Figure 29:
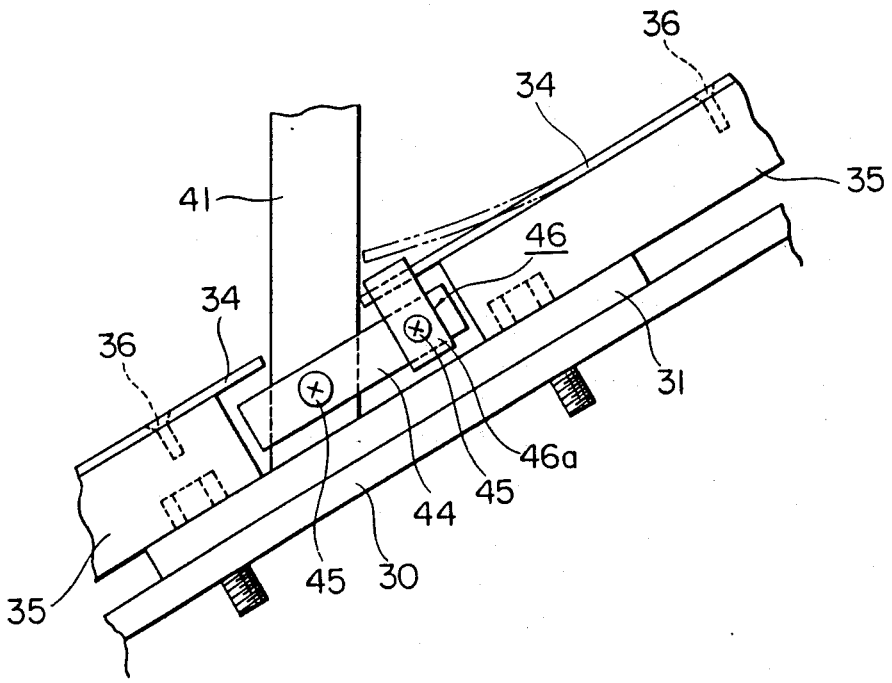
FIG. 29 is a sectional view taken along Line XXIX—XXIX of FIG. 28.

FIGS. 28 and 29 illustrate another embodiment of the present invention in which springback is prevented. In the figures, reference numeral 44 designates a rectangular plate secured to the support post 41 and the mount rail 35 located on the side of the balustrade panel 29 by means of screws 45 as shown in FIG. 28. The rectangular plate 44 is disposed along the slope of the escalator. Reference numeral 46 designates a mounting member having an L-shaped cross section, one leg 46*a* of which is secured by a screw 45 to the side face of the rectangular plate 44 and the other leg **46*b* of which firmly holds the end portion of the outer deck board 34 which is secured to the support rail 35'. The inner edge of the outer deck board 34 which is held downward by the mounting member 46 is covered by a soft packing 47*b* having an L-shaped cross section. One side of the soft packing 47*b* is held between the balustrade panel 29 and the screw 45 along the balustrade panel 29**.

It is to be noted that since the rectangular plate 44 and the mounting member 46 are assembled before the inner deck board 38 is installed, there is no interference by the support post 41.

According to this embodiment, since the end portion of the outer deck board 34 is held against the mount rail 35 by a mounting member 46, springback of the outer deck board 34 in the vicinity of the support post 41 which occurs in the conventional design can be prevented to provide a smooth, flat surface.

What is claimed is:

1. A balustrade structure for a curved escalator comprising a curved main frame, an inclined curved balustrade mount member on said frame, a vertical balustrade panel having a mounting portion carried by said mount member, and a balustrade panel mounting portion cover constructed of outer and inner deck boards for mounting on outer and inner sides of said balustrade panel secured to said inclined curved balustrade mount member, said boards comprising strips of sheet material curved in plan and straight in the entire transverse direction before mounting, and joints comprising means for retaining edges of said inner and outer deck boards in a manner which will accommodate deviation from a two-dimensional shape, said sheet material having a thickness which is so very much smaller than a radius of said curved escalator that said inner and outer deck boards are caused to twist three-dimensionally upon mounting.

2. A balustrade structure as claimed in claim 1 wherein said retaining means is a support member mounted on said frame for covering a longitudinally-extending side edge of each of said deck boards.

3. A balustrade structure as claimed in claim 1 wherein each of said outer and inner decks comprises a main deck and end decks, and said retaining means includes a slot in an edge portion of each of said end decks to receive a longitudinally-extending side edge of the lengthwise end portion of a main deck board, said slot having a width greater than the thickness of the main deck boards, and a space between said slot and the main deck board being filled with a shim which is secured to said end deck.

4. A balustrade structure for a curved escalator comprising a curved main frame, a curved balustrade mount member on said frame having inclined and horizontal sections, a vertical balustrade panel having a mounting portion carried by said mount member, and a balustrade panel mounting portion cover constructed of outer and inner decks including deck boards for mounting on outer and inner sides of said balustrade panels secured to the inclined section of said mount member, said deck boards comprising strips of sheet material which are curved in plan and straight in the entire transverse direction before mounting and which are twisted into a three-dimensional shape upon mounting, said outer and inner decks including a main deck and an end deck disposed at the lengthwise ends of the main deck and attached to the deck boards for covering the ends of the deck boards, and joints comprising means for retaining edges of said inner and outer deck boards in a manner which will accommodate deviation from an initial two-dimensional shape and allow said inner and outer deck boards to conform to a three-dimensional shape upon mounting.

5. A balustrade structure as claimed in claim 4 wherein said retaining means includes a slot in an edge portion of each end deck to receive a longitudinally-extending side edge of the lengthwise end portion of a main deck board.

6. A balustrade structure for a curved escalator having a curved main frame comprising a support post disposed on a side edge of the curved main frame, a balustrade panel supported by said support post, a mount member secured to said main frame, deformable outer and inner deck boards secured to said mount member to assume a forced three-dimensional shape and cover the mounting portion of said balustrade panel, and a packing attached to said mount member for covering a longitudinally-extending side edge of said inner deck board close to said balustrade panel and contacting said mount member, said mount member having a groove in its side surface, and said packing comprising an elongated member of a hard synthetic resin having a U-shaped cross section, said packing having a strength sufficient to prevent the deformation of said inner deck board due to springback with one leg portion of the U-shaped section engaged with the side edge of said inner deck board and clamping said inner deck board to said mount member and with the other leg portion inserted into the groove of said mount member, said packing thereby firmly holding the side edge of said inner deck board clamped against said mount member.

7. A balustrade structure as claimed in claim 6, wherein said packing member is made of a hard vinyl chloride resin.

8. A balustrade structure as claimed in claim 6, wherein said packing member is made of ABS resin.

9. A balustrade structure for a curved escalator having a curved main frame comprising a support post disposed on a side edge of the curved main frame, a balustrade panel supported by said support post, a mount member secured to said main frame, outer and inner deck boards secured to said mount member to cover the mounting portion of said balustrade panel, and a packing attached to said mount member for covering a longitudinally-extending side edge of said outer deck board close to said balustrade panel, said support post having secured thereon a support member, said support member having mounted thereon a mounting member having an L-shaped cross section, one leg of the "L" being pressed against the side edge of said outer deck board and the other leg of the "L" being secured to said mount member through said support member, and said mounting member being covered by said packing.

10. A balustrade structure as claimed in claim 9 wherein said packing has an L-shaped cross section.

* * * * *